United States Patent [19]

Griffis

[11] Patent Number: 5,003,794

[45] Date of Patent: Apr. 2, 1991

[54] METHOD AND MEANS FOR LAUNDERING CONTAMINATED CLOTHING

[76] Inventor: Steven C. Griffis, 2929 Avenue D, Council Bluffs, Iowa 51501

[21] Appl. No.: 489,221

[22] Filed: Mar. 6, 1990

[51] Int. Cl.[5] ..... B08B 15/00; D06F 35/00

[52] U.S. Cl. ..... 68/3 R; 8/159; 68/210

[58] Field of Search ..... 8/159; 68/3 R, 210; 252/630, 631

[56] References Cited

U.S. PATENT DOCUMENTS

| | | | |
|---|---|---|---|
| 2,902,138 | 9/1959 | Oelkers | 68/3 R X |
| 3,550,169 | 12/1970 | Forse | 68/3 R X |
| 3,577,752 | 5/1971 | Hertig et al. | 68/210 |
| 3,597,943 | 8/1971 | Gayring | 68/210 |
| 3,742,738 | 7/1973 | Frotried | 68/210 |
| 4,224,810 | 9/1980 | Crowell | 68/3 R |
| 4,561,268 | 12/1985 | Southwick et al. | 68/210 |

FOREIGN PATENT DOCUMENTS

| | | | |
|---|---|---|---|
| 887755 | 12/1971 | Canada | 8/159 |
| 2522116 | 11/1976 | Fed. Rep. of Germany | 68/210 |
| 3303176 | 12/1988 | Japan | 68/3 R |

*Primary Examiner*—William A. Cuchlinski, Jr.
*Assistant Examiner*—G. B. Bennett
*Attorney, Agent, or Firm*—Zarley, McKee, Thomte, Voorhees & Sease

[57] ABSTRACT

A method and means for laundering contaminated clothing comprising a facility which is generally divided into a wash side and a dry side with several other rooms being associated therewith. The facility and the method described in association therewith permits contaminated clothing to be brought into the wash side of the facility, laundered and passed into the drying side of the facility. Once in the drying side of the facility, the clothes may be dried and then bagged for subsequent removal. The method prevents contaminants from being released into the atmosphere or carried from the interior of the facility by the person conducting the laundry operation.

1 Claim, 5 Drawing Sheets

METHOD AND MEANS FOR LAUNDERING CONTAMINATED CLOTHING

BACKGROUND OF THE INVENTION

This invention relates to a method and means for laundering contaminated clothing.

Airborne asbestos contamination in buildings is a significant environmental problem. Various diseases have been linked with industrial exposure to airborne asbestos, and the extensive use of asbestos products in buildings has raised concerns about exposure to asbestos in nonindustrial settings. Surveys conducted by the Environmental Protection Agency (EPA) estimate that asbestos-containing materials can be found in approximately 31,000 schools and 733,000 other public and commercial buildings in the country.

In an effort to avoid the hazards associated with exposure to airborne asbestos, abatement actions or procedures are being extensively conducted and the Environmental Protection Agency has published a booklet entitled "Guidance for Controlling Asbestos-Containing Materials in Buildings". During the abatement action, one or more air filtration units, usually several air filtration units, are positioned throughout the work site to filter the air in the work area.

The workers performing the asbestos abatement procedures are required to wear protective clothing and respirators. In many cases, the protective clothing is simply disposed of when the worker removes the same. The replacement cost of the protective clothing is quite high which necessarily increases the cost of the abatement program. Since the clothing is contaminated with asbestos fibers, strict safety procedures must be followed if the clothing is to be laundered for subsequent use. For example, care must be exercised to prevent the escape of asbestos fibers into the atmosphere during the laundering process. Further, means must be provided for segregating the area in which the contaminated clothing is washed from the area in which the "clean" clothes are dried. A further complicating factor is that the washed clothes may still have some asbestos residue therein. Yet another problem associated with the laundering of contaminated clothing is the disposal of the dirty wash water which contains asbestos materials.

It is therefore a principal object of the invention to provide an improved method and means for laundering contaminated clothing.

A further object of the invention is to provide an improved method and means for laundering contaminated clothing which ensures that contaminants will not be released into the atmosphere.

A further object of the invention is to provide an improved method and means for laundering contaminated clothing including means for properly venting the wash and dry areas.

A further object of the invention is to provide an improved method and means for laundering contaminated clothing including means for filtering the contaminated wash water.

These and other objects of the present invention will be apparent to those skilled in the art.

SUMMARY OF THE INVENTION

A method and means for laundering contaminated clothing is described wherein an enclosure is created to define a wash side and a dry side. Various vented rooms are provided on the wash and dry sides of the enclosure to permit the operator to enter the wash and dry sides to perform the washing and drying procedures in such a manner so as to prevent the escape of contaminants from the enclosure and to ensure that the washed clothes will not be contaminated during the drying procedures. Means is also provided for the disposal of the contaminated wash water.

DESCRIPTION OF THE PREFERRED EMBODIMENT

Figure 1:
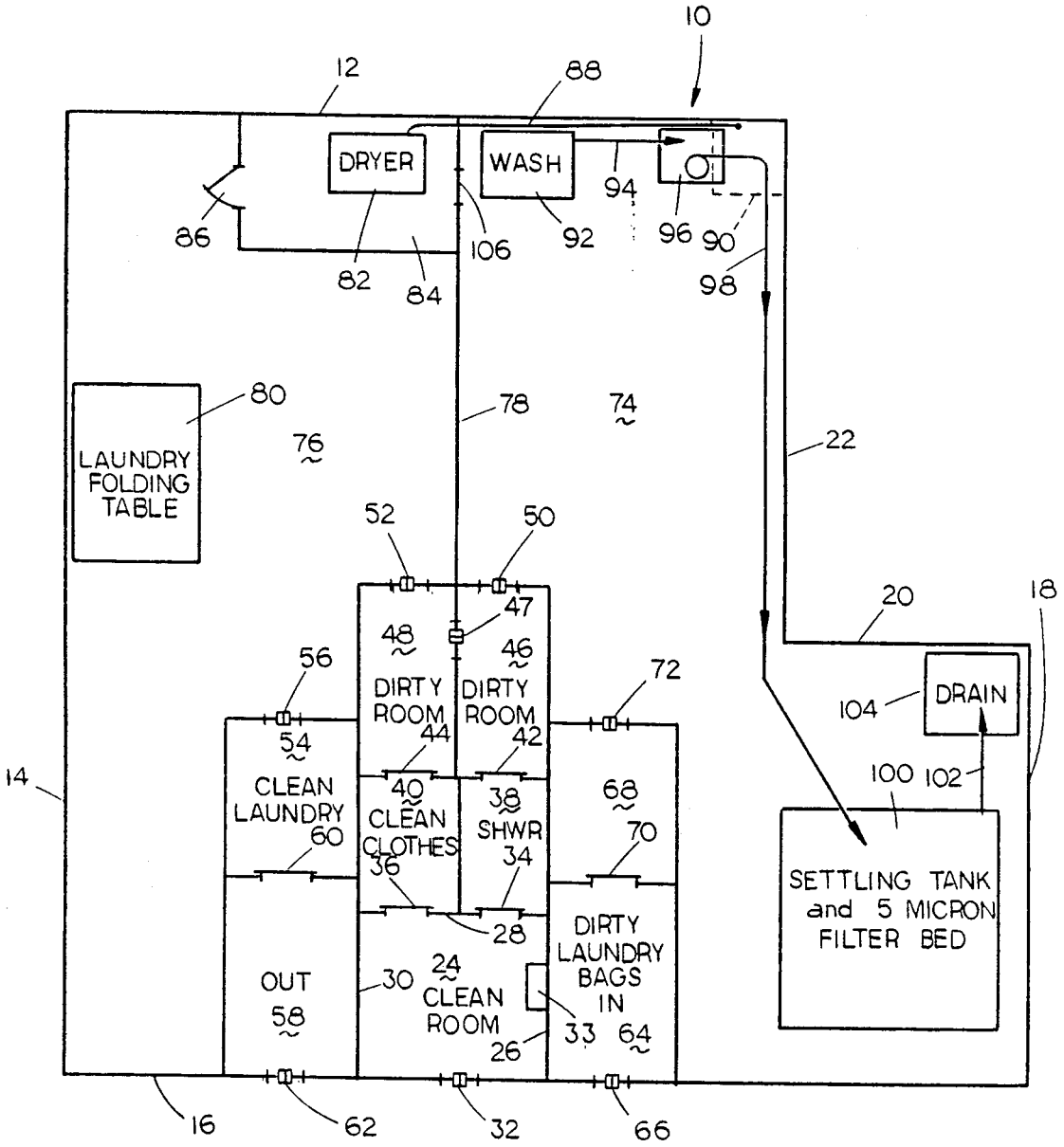
FIG. 1 is a schematic of the floor plan of the laundry facility of this invention.

Referring to the drawing, the numeral 10 generally designates the overall facility divided into several different areas and rooms as will now be described. Facility 10 includes outer walls 12, 14, 16, 18, 20 and 22. Facility 10 includes a clean room 24 defined by walls 16, 26, 28 and 30. Vented door 32 is provided in wall 16 and flap doors 34 and 36 are provided in wall 28. Control console 33 is positioned in clean room 24 for controlling the AFM 90. The flap doors are conventional in design and simply consist of an opening having a flexible plastic member or the like positioned thereover. As seen in FIG. 1, the doors 34 and 36 are positioned so that air may pass outwardly through the doors 34 and 36 into the shower room 38 and clean clothes room 40 and to prevent air from moving from the shower room 38 into the clean room 24 and to prevent air from moving from the clean clothes room 40 into the clean room 24. Flap doors 42 and 44 are provided between the shower room 38 and dirty room 46 and clean clothes room 40 and dirty room 48 respectively. Rooms 46 and 48 are provided with vented doors 50 and 52 respectively. Vented door 47 is positioned between rooms 46 and 48 (FIGS. 1).

Clean laundry room 54 is provided at one side of the rooms 40 and 48 and has a vented door 56 provided therein. Clean laundry room 54 is positioned adjacent out room 58 and has a flap door 60 positioned therebetween. Out room 58 is provided with a vented door 62 created in wall 16.

Room 64 is positioned adjacent clean room 24 and is designated as a dirty laundry bags room having a vented door 66 provided in wall 16. Room 68 is positioned adjacent room 64 and has a flap door 70 positioned therein. Room 68 also has a vented door 72 formed therein which communicates with the area in the facility generally referred to by the reference numeral 74 which is separated from area 76 by wall 78.

Laundry folding table 80 is provided in area 76 to enable a worker to fold laundry thereon which has been removed from the dryer 82 located in room 84. Door 86 permits access into room 84 as seen in FIG. 1. Dryer 82 has a dryer vent line 88 extending therefrom which is in communication with the intake of a conventional air filtration machine 90. Washing machine 92 is provided in area 74 and has a drain line 94 extending therefrom to a sink and sump pump 96. Waste water line 98 extends from the sink and sump pump 96 to a settling tank and 5 micron filter bed referred to generally by the reference numeral 100 and which will be described in more detail hereinafter. Tank 100 has a drain line 102 extending therefrom to a drain 104.

The settling tank and filter bed apparatus 100 generally comprises a settling tank 110 and a filter bed 112. Tank 110 includes an open upper end 114, opposite side walls 116 and 118 and opposite end walls (not shown). A V-shaped filter 120 is positioned in the tank 110 and has its opposite ends welded to the end walls of the tank 110. The filter material in filter 120 is designed to retain suds, dirt, lint, etc. to protect the 5 micron filter as will be described in more detail.

Gauge glass 122 is provided at one side of the tank and has its upper and lower ends communicating with openings 124 and 126 in tank 110. A pair of drain lines 128 and 130 extend from the interior of the filter 120 as seen in FIG. 8 and have valves 132 and 134 imposed therein. The lower ends of the lines 128 and 130 are provided with a plurality of nozzles 136 or the like which are designed to sprinkle or spray the water from the tank 110 onto the 5 micron filter material 138 supported upon a woven wire tray 140. The water which passes through the 5 micron material 13 collects in the bottom of the filter bed 112 and is drained to the sewer by means of drain 142.

Figure 5:
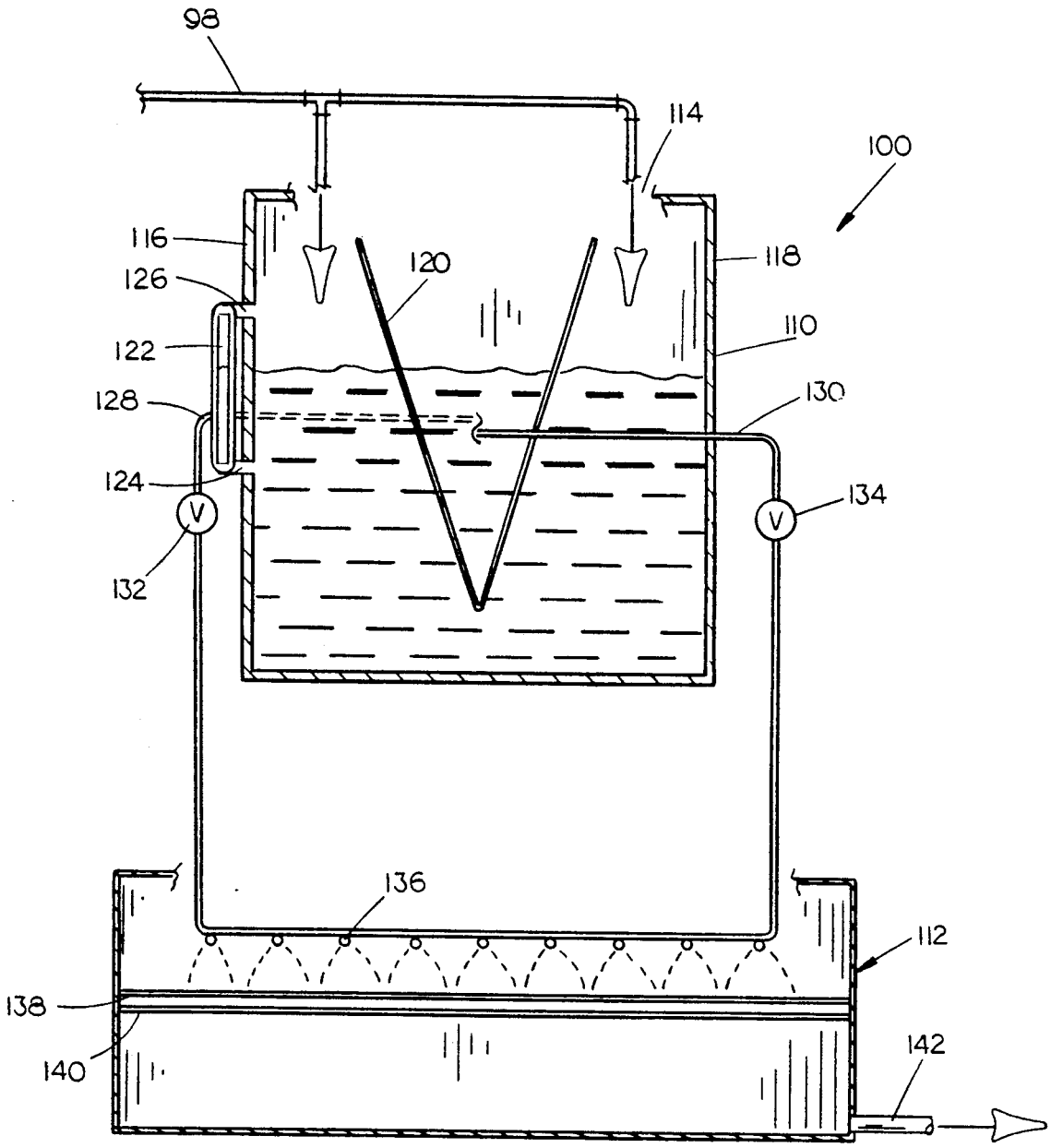
FIG. 5 is a sectional view of the settling tank and filter pad portion of this invention.

The dirty water from the washer enters the interior of the tank 110 as illustrated in FIG. 5. The water is allowed to collect and settle in the tank 110 until the water lever therein receives a predetermined height as viewed in the gauge glass 122. The filter 120 contains suds, dirt, lint, etc. so that the same is not passed to the 5 micron filter material 138. The dirty water in the tank 110 is allowed to settle so that large particles therein will settle to the bottom of tank 110. When the water reaches a predetermined level in tank 110, valves 132 and 134 are opened so that a certain amount of the water is drained from the tank while the heavy material is allowed to settle to the bottom of the tank 110. It should be noted that the water so drained has passed through filter 120.

Figure 2:
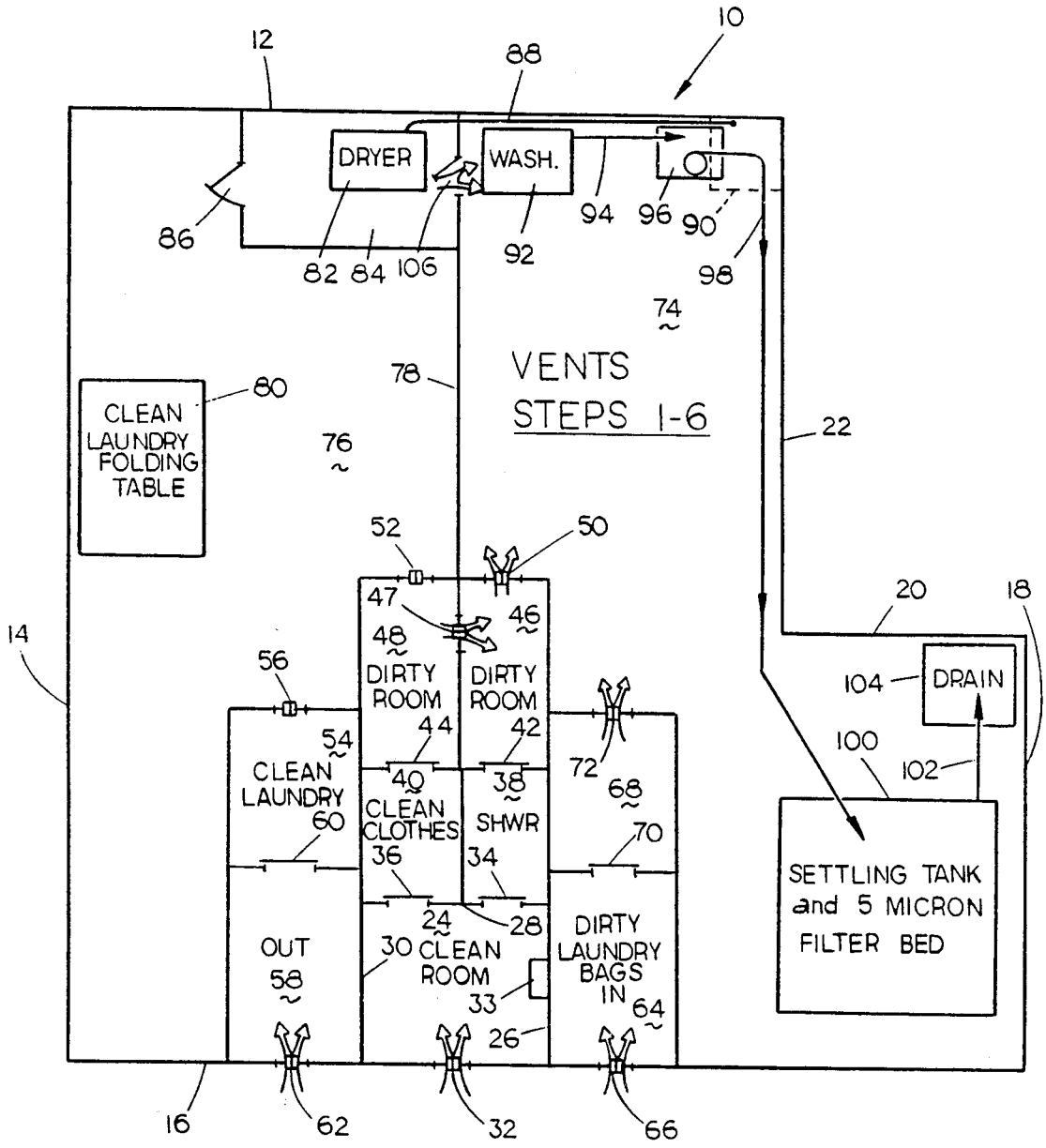
FIG. 2 is a schematic similar to FIG. 1 except that the position of the various vents are illustrated during steps 1–6.
Figure 3:
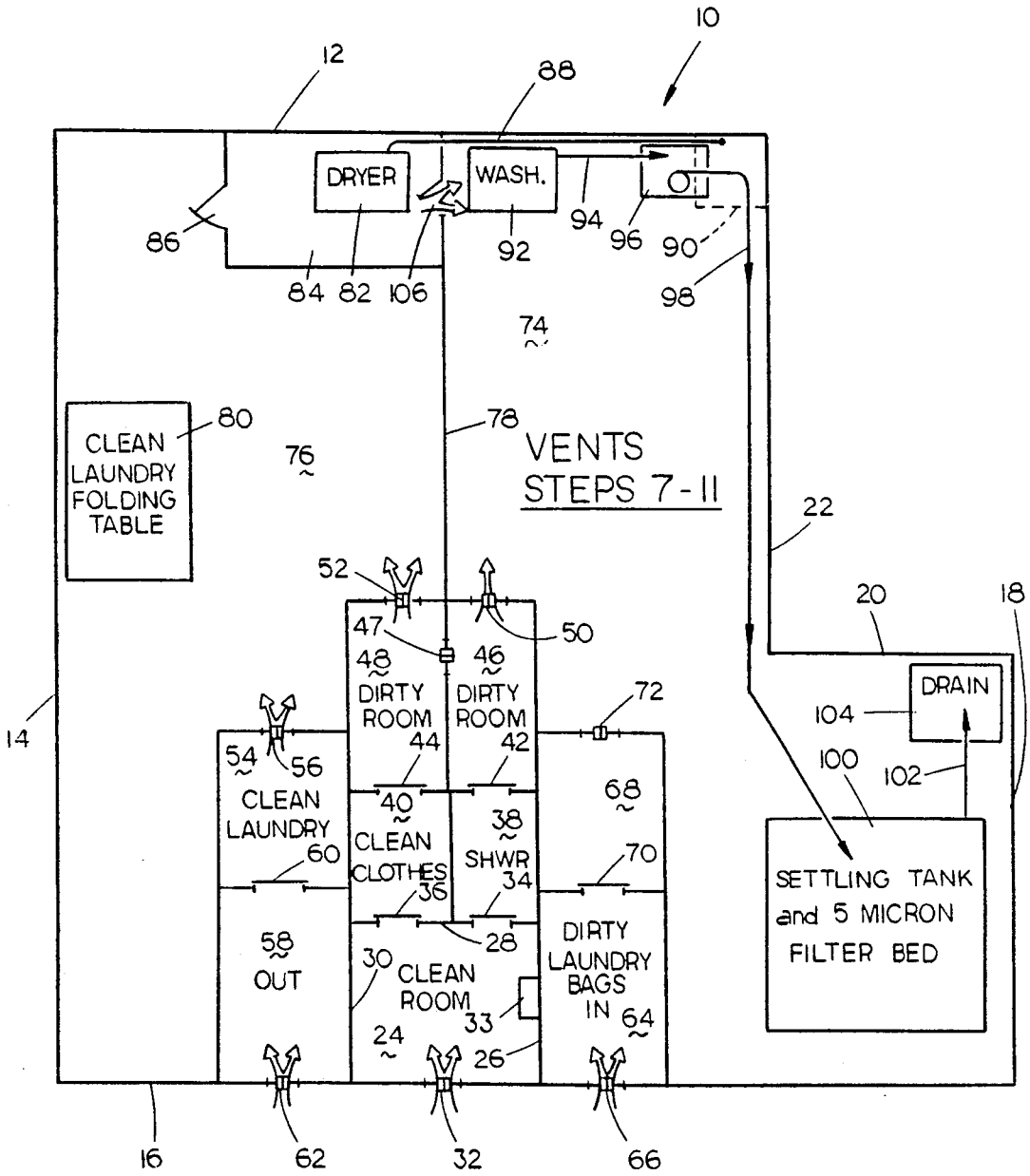
FIG. 3 is a schematic similar to FIG. 1 except that the position of the various vents are illustrated during steps 7–11.
Figure 4:
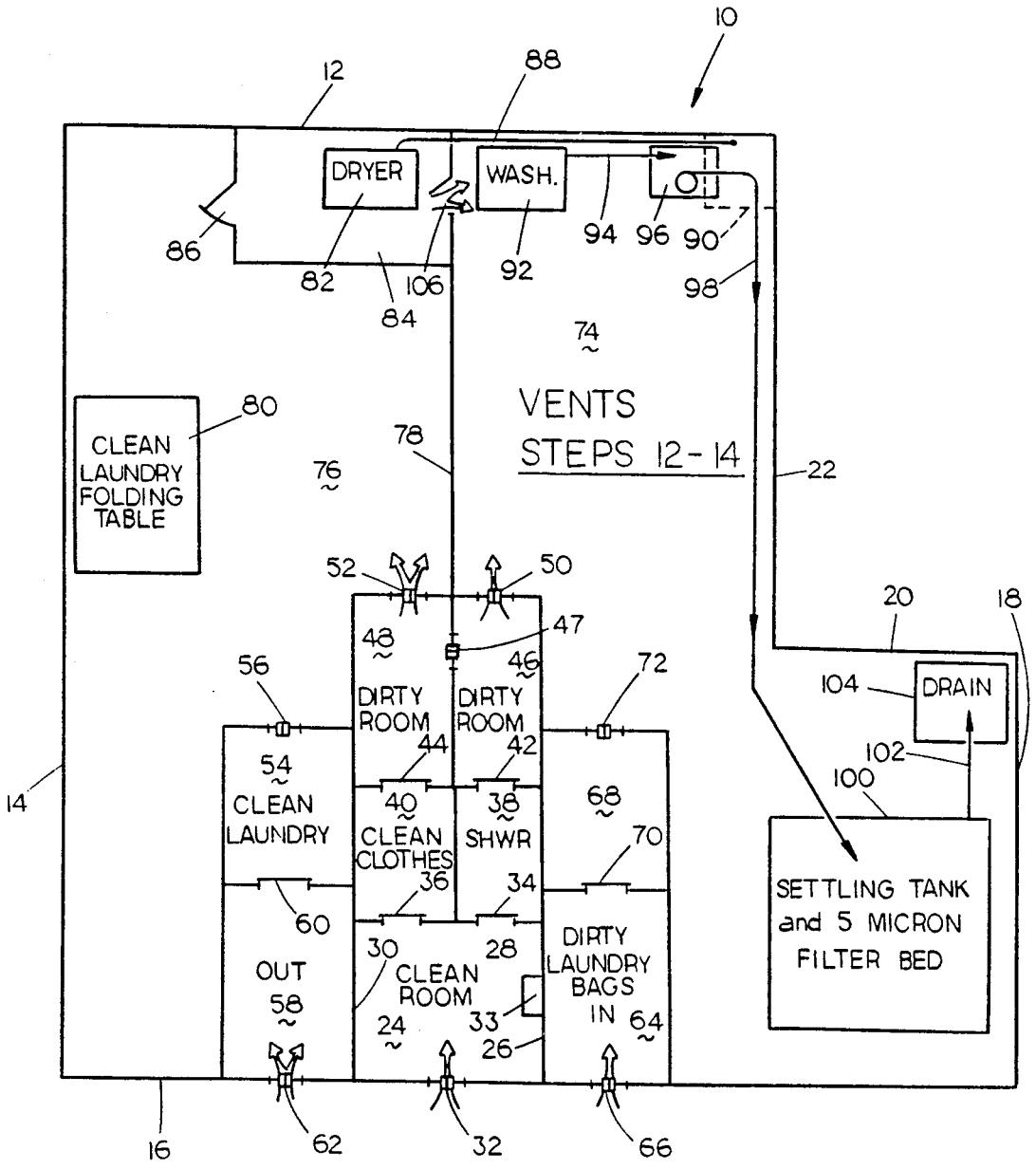
FIG. 4 is a schematic similar to FIG. 1 except that the position of the various vents are illustrated during steps 12–14.

FIG. 1 illustrates the overall layout of the facility as previously described. FIG. 2 illustrates the condition of the vents during steps 1–6 with the double arrows illustrating the vents being completely opened and the single arrows representing the vents partially opened. FIG. 3 illustrates the vents during steps 7–11 while FIG. 4 illustrates the vents in steps 12–14.

STEP ONE

The operator opens the entry door vents on the vented doors 32 and 66 of clean room 24 and dirty laundry bags in room 64.

STEP TWO

The operator enters clean room 24 through the vented door 32 and removes all of his/her clothing. The operator then puts on a conventional respirator.

STEP THREE

The operator enters the clean clothes room 40 through door 36 and puts on work clothing. The vent in door 52 is then closed and the operator enters dirty room 46 through door 47 which is then closed. The vent in door 47 is then opened.

STEP FOUR

The operator goes into the washer area 74 and opens the vents on the doors 50 and 72. The vent at pass-through door 106 is then partially closed.

STEP FIVE

The operator picks up the dirty clothes from the dirty laundry room 64 and the dirty room 46 and washes the clothing in the washer 92. The washer will pump the dirty water directly into the sink 96. Sump pump 96 pumps the dirty water to the settling tank 110.

STEP SIX

The dirty water level in the settling tank 110 is observed and is drained to the filter pad 138 when the settling tank is full as will be described in more detail hereinafter.

STEP SEVEN

The wet, clean clothes from the washer 92 are passed through the pass-through window 106. The vent in door 72 is then closed and the vent in door 50 is half closed.

STEP EIGHT

The operator leaves the washer area 74 through the dirty room 46 to the shower room 38. The operator removes his/her clothing and places the same in a plastic bag and leaves the same in room 46. The operator then showers and cleans his/her respirator.

STEP NINE

After cleaning his/her respirator, the operator again puts on the respirator. The operator then goes to the clean clothes room 40 by way of the clean room 24 and puts on clean clothing. The operator then goes into the dirty room 48 and closes the vent in door 47.

STEP TEN

The operator then goes into the dryer area 76 by way of the door 52 and opens the vents on doors 56 and 52 and at the pass-through window 106.

STEP ELEVEN

The wet clothing is dried in the dryer 82. The dried clothing is folded on the laundry table 80 and bagged. The folded and bagged laundry is then placed in the clean laundry area 58. Vent in door 56 is then closed.

STEP TWELVE

The operator leaves the dryer area 76 and goes into the dirty room 48. The operator then goes into dirty room 46 and leaves his/her clothing in dirty room 46 and takes a shower in room 38. The operator then cleans his/her respirator and leaves the respirator in the clean room 24.

STEP THIRTEEN

The operator puts on street clothes in the clean room 24.

STEP FOURTEEN

Operator partially closes the door vents in door 32 and/or 66 and departs the area.

Thus, it can be seen that a novel method and means has been provided for laundering contaminated clothing in a manner which assures that contaminants from the clothing will not be released to the atmosphere or will not be carried out of the facility by the person laundering the contaminated clothing. Thus it can be seen that the invention accomplishes at least all of its stated objectives.

I claim:

1. A contaminated clothing laundering facility, comprising, an enclosure defining a washer side and a dryer side, said washer side and said dryer side further defining a wash room and a dry room respectively, a clean room in communication with said washer side and said dryer side and having a first selectively vented exit door which communicates with the area outside of said enclosure, said clean room also having spaced apart second and third flap doors for permitting air to flow outwardly from said clean room, a shower room on said washer side in communication with said clean room via said first flap door and having a flap door provided therein which permits air to flow outwardly from said shower room, a first dirty room on said washer side and having a first selectively vented door in communication with said wash room, and a second selectively vented door in communication with said dryer side, said first dirty room being in communication with said shower room via said flap door in said shower room, a dirty laundry bags room in said washer side and having a first selectively vented exit door provided therein which communicates with the area outside of said enclosure, said dirty laundry bags room also having a flap door provided therein for permitting air to flow outwardly therefrom, a dirty laundry room adjacent said dirty laundry bags room in communication therewith via said flap door of said dirty laundry bags room, said dirty laundry room also having a selectively vented door provided therein which communicates with said wash room, a clothes washer in said wash room, a dirty water disposal means associated with said washer, an air filtering machine in said wash room for creating a negative pressure within said wash side so that air will be drawn into said wash side through said vented exit doors of said clean room and said dirty laundry bags room, a clean clothes room on said dryer side in communication with said clean room via said second flap door in said clean clothes room, said clean clothes room having a first flap door provided therein for permitting the flow of air outwardly therefrom, a second dirty room adjacent said clean clothes room and being in communication therewith via said second flap door of said clean clothes room, said dirty room also being in communication with said first dirty room on said washer side via said second vented door in said first dirty room on said washer side, said second dirty room having a selectively vented door provided therein which communicates with said dry room, an out room in said dryer side and having a selectively vented exit door provided therein which communicates with the area outside of said enclosure, said out room also having a flap door provided therein for permitting the flow of air outwardly therethrough, a clean laundry room adjacent said out room and being in communication therewith via said flap door of said out room, said clean laundry room also having a selectively vented door formed therein which communicates with said dry room, a clothes dryer in said dry area, a pass-through opening between said dry room and said wash room whereby washed laundry may be passed from said wash room into said dry room for drying, said pass-through opening also providing a means by which air will flow from said dry room into said wash room thereby preventing the airborne movement of contaminants from said wash room into said dry room.

* * * * *